US009565949B2

(12) United States Patent
Peterson

(10) Patent No.: US 9,565,949 B2
(45) Date of Patent: Feb. 14, 2017

(54) CHAIR UPHOLSTERY ATTACHMENT ARRANGEMENT AND METHOD

(71) Applicant: Steelcase Inc., Grand Rapids, MI (US)

(72) Inventor: Gordon Jay Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/718,726

(22) Filed: May 21, 2015

(65) Prior Publication Data

US 2015/0342364 A1 Dec. 3, 2015

Related U.S. Application Data

(60) Provisional application No. 62/005,482, filed on May 30, 2014.

(51) Int. Cl.

| | |
|---|---|
| ***A47C 31/02*** | (2006.01) |
| ***A47C 7/02*** | (2006.01) |
| ***A47C 7/18*** | (2006.01) |
| ***A47C 7/24*** | (2006.01) |

(52) U.S. Cl.

CPC ..... *A47C 31/026* (2013.01); *A47C 7/24* (2013.01); *A47C 31/023* (2013.01)

(58) Field of Classification Search

CPC ..... A47C 31/026; A47C 31/023; A47C 7/24
USPC ..... 297/218.1, 218.2, 218.3, 218.4, 218.5,297/452.12, 452.13, 452.14, 452.15, 452.38,297/452.58, 452.59, 452.6, 452.61
See application file for complete search history.

(56) References Cited

U.S. PATENT DOCUMENTS

| | | | |
|---|---|---|---|
| 1,782,815 | A | 11/1930 | Fry |
| 1,785,359 | A | 12/1930 | Oldham |
| 1,947,931 | A | 2/1934 | Falls |
| 2,101,001 | A | 11/1937 | Balduf |
| 2,275,683 | A | 3/1942 | Rutledge |
| 2,345,325 | A | 3/1944 | Churchill |
| 2,361,370 | A | 10/1944 | Grunwald |
| 2,531,271 | A | 11/1950 | Hoehn |
| 2,809,692 | A | 10/1957 | Sarge |
| 3,022,522 | A | 2/1962 | Neely |
| 3,089,269 | A | 5/1963 | Mckiernan |

(Continued)

FOREIGN PATENT DOCUMENTS

| | | |
|---|---|---|
| DE | 3321410 | 12/1984 |
| EP | 122046 | 10/1984 |

(Continued)

*Primary Examiner* — Rodney B White
(74) *Attorney, Agent, or Firm* — Price Heneveld LLP

(57) ABSTRACT

A chair includes a chair component comprising a polymeric material and adapted to at least partially support a seated user, wherein the chair component includes a first surface and a second surface opposite the first surface, and wherein the chair component further includes a plurality of apertures capable of being accessed from at least the second surface of the chair component. The chair further includes a cover that extends over at least a portion of the first surface and a portion of the second surface which includes the plurality of apertures, and at least one staple comprising a polymeric material, wherein each staple of the at least one staple includes a pair of prongs, and wherein at least one of the prongs extends through the cover extending over the portion of the second surface and is received and retained within one of the plurality of apertures, thereby securing the cover to the chair member.

30 Claims, 9 Drawing Sheets

(56) References Cited

U.S. PATENT DOCUMENTS 3,165,968 A 1/1965 Anstett
3,174,797 A 3/1965 Neufeld
3,528,693 A 9/1970 Ford et al.
3,591,997 A 7/1971 Tennison, Jr. et al.
3,618,447 A 11/1971 Goins
3,647,260 A * 3/1972 Grant ..... A47C 7/185 297/218.1
3,669,499 A * 6/1972 Semplonius ..... A47C 3/12 297/452.38 X
3,722,950 A * 3/1973 Harnick ..... A47C 31/02 297/218.1
3,757,629 A 9/1973 Schneider
3,788,701 A * 1/1974 Massaccesi ..... A47C 3/12 297/452.38 X
3,801,154 A * 4/1974 Hultquist ..... A47C 31/023 297/218.1
3,851,920 A * 12/1974 Harris ..... A47C 3/12 297/452.55 X
3,905,071 A 9/1975 Brumlick
3,915,299 A 10/1975 Miyaoku
3,928,898 A * 12/1975 Smoot ..... A47C 31/023 297/218.1 X
3,949,989 A 4/1976 Van Meter
3,960,197 A 6/1976 Daniels
4,257,613 A 3/1981 Meyer
4,296,964 A 10/1981 Haack
4,418,958 A 12/1983 Watkins
4,428,376 A 1/1984 Mericle
4,718,153 A 1/1988 Armitage et al.
4,740,034 A * 4/1988 Snyder ..... A47C 9/00 297/452.59 X
4,789,201 A 12/1988 Selbert
4,836,609 A * 6/1989 Hill ..... B60N 2/686 297/218.1
4,852,930 A 8/1989 Agee
4,900,085 A * 2/1990 Tobler ..... A47C 7/40 297/452.38 X
4,971,503 A 11/1990 Barnell et al.
5,015,034 A 5/1991 Kindig et al.
5,118,162 A * 6/1992 Saul ..... A47B 95/043 297/452.38 X
5,169,158 A 12/1992 Neville
5,189,766 A 3/1993 Weber
5,193,817 A 3/1993 Pan
5,288,136 A * 2/1994 Webber ..... A47C 7/282 297/452.13 X
5,290,004 A 3/1994 Frost et al.
5,297,851 A 3/1994 Van Hekken
5,314,240 A 5/1994 Ishi et al.
5,324,307 A 6/1994 Jarrett et al.
5,487,591 A 1/1996 Knoblock
5,503,454 A * 4/1996 Sakamoto ..... B60N 2/686 297/218.1
5,522,645 A * 6/1996 Dahlbacka ..... B60N 2/449 297/452.14
5,522,817 A 6/1996 Sanders et al.
5,527,097 A 6/1996 Martin
5,547,325 A 8/1996 Tucker et al.
5,560,677 A * 10/1996 Cykana ..... B60N 2/5825 297/218.3
5,582,460 A 12/1996 Schultz
5,601,333 A * 2/1997 Bostrom ..... A47C 31/06 297/218.1
5,628,545 A 5/1997 Perthuis
5,630,643 A * 5/1997 Scholten ..... A47C 3/12 297/218.2
5,672,038 A 9/1997 Eaton
D387,202 S 12/1997 Junkins
5,704,691 A 1/1998 Olson
5,795,121 A 8/1998 Tucker et al.
5,845,967 A 12/1998 Kane et al.
6,033,027 A 3/2000 Conner et al.
6,042,187 A 3/2000 Conner et al.
6,168,362 B1 1/2001 Tucker et al.
6,220,661 B1 * 4/2001 Peterson ..... A47C 7/24 297/218.4
6,283,552 B1 9/2001 Halse et al.
6,394,546 B1 * 5/2002 Knoblock ..... A47C 1/023 297/284.4
6,508,509 B2 1/2003 Peterson
7,051,884 B2 5/2006 Dick
7,419,212 B2 9/2008 Haygood et al.
7,425,040 B1 9/2008 Honma
7,490,392 B2 * 2/2009 Peterson ..... A47C 7/185 297/452.58 X
7,527,335 B2 5/2009 Eberlein et al.
7,581,911 B2 9/2009 Tucker et al.
7,837,260 B2 11/2010 Hein et al.
7,845,501 B1 12/2010 Fosburg et al.
8,029,066 B2 10/2011 Su
8,109,124 B2 2/2012 Lin
8,109,401 B2 2/2012 Davis
8,152,235 B2 4/2012 McElmurry
8,192,571 B2 6/2012 Tucker et al.
8,764,115 B2 * 7/2014 Brandtner ..... A47C 31/026 297/452.38
8,973,990 B2 * 3/2015 Krupiczewicz ..... A47C 31/02 297/218.1
9,004,604 B2 * 4/2015 Bogard ..... A47C 7/28 297/452.13 X
9,010,866 B2 * 4/2015 Tanaka ..... B60N 2/5825 297/452.58
2002/0195777 A1 12/2002 Cho
2003/0021655 A1 1/2003 Correll et al.
2005/0017554 A1 * 1/2005 Mizelle ..... A47C 4/06 297/218.3
2005/0194829 A1 * 9/2005 Aerts ..... A47C 31/023 297/452.59
2005/0242651 A1 * 11/2005 Peitz ..... A47C 7/62 297/452.38
2006/0060263 A1 3/2006 Inoue
2007/0096520 A1 * 5/2007 Haygood ..... A47C 31/026 297/218.5
2008/0078808 A1 4/2008 Hess
2009/0053011 A1 2/2009 Brackett
2010/0176633 A1 7/2010 Brncick et al.

FOREIGN PATENT DOCUMENTS

EP 511030 10/1992
JP 2002360957 12/2002
WO 03020106 3/2003

* cited by examiner

CHAIR UPHOLSTERY ATTACHMENT ARRANGEMENT AND METHOD

BACKGROUND OF THE INVENTION

The present invention relates to a chair assembly, and in particular to an office chair assembly comprising a back assembly including an upholstery arrangement that wraps around a polymeric back shell and is secured thereto by a plurality of polymeric staples.

SUMMARY OF THE INVENTION

One aspect of the present invention is to provide a chair that includes a chair component comprising a polymeric material and adapted to at least partially support a seated user, wherein the chair component includes a first surface and a second surface opposite the first surface, and wherein the chair component further includes a plurality of apertures capable of being accessed from at least the second surface of the chair component. The chair further includes a cover that extends over at least a portion of the first surface and a portion of the second surface which includes the plurality of apertures, and at least one staple comprising a polymeric material, wherein each staple of the at least one staple includes a pair of prongs, and wherein at least one of the prongs extends through the cover extending over the portion of the second surface and is received and retained within one of the plurality of apertures, thereby securing the cover to the chair member.

Another aspect of the present invention is to provide a chair that includes a chair component comprising a polymeric material and adapted to at least partially support a seated user, wherein the chair component includes a first surface and a second surface opposite the first surface, and wherein the chair component further includes a plurality of apertures engaged in at least one array and capable of being accessed from at least the second surface of the chair component. The chair further includes an upholstery element that extends over at least a portion of the first surface and a portion of the second surface which includes a plurality of apertures so as to at least partially cover a portion of the plurality of apertures, and at least one fastener comprising a polymeric material, wherein the at least one fastener engages the upholstery element that extends over the portion of the second surface and is received and retained within at least one aperture of the plurality of apertures, thereby securing the upholstery element to the chair component.

Yet another aspect of the present invention is to provide an article of furniture that includes a furniture component comprising a polymeric material, wherein the furniture component includes a first surface and a second surface opposite the first surface, and a compliant material that wraps around at least a portion of the furniture component and covers at least a portion of the first surface and a portion of the second surface. The article of furniture further includes at least one staple comprising a polymeric material that couples the compliant material to the furniture component, wherein each staple of the at least one staple comprises two prongs, and wherein each prong extends through the compliant material and into the furniture component through the second surface.

Still another aspect of the present invention is to provide a method of constructing a chair that includes providing a first chair structure comprising a polymeric material having a first surface and a second surface opposite the first surface, wherein the first surface and the second surface cooperate to define a first thickness therebetween, and wherein the first chair structure includes at least one attachment area, providing a second chair structure, and locating the second chair structure proximate the first chair structure such that at least a portion of the second chair structure covers the first chair structure. The method further includes providing at least one staple member comprising the polymeric material, and inserting the at least one staple member through the first chair structure and the second chair structure with a staple gun, thereby securing the first chair structure to the second chair structure.

Yet another aspect of the present invention is to provide a method of constructing a chair that includes providing a first chair structure comprising a first polymeric material having a first surface and a second surface opposite the first surface, wherein the first chair structure includes a densely-spaced array of apertures extending between the first and second surfaces, providing a second chair structure, and locating the second chair structure proximate the first chair structure such that at least a portion of the second chair structure obscures at least a portion of the densely-spaced array of apertures. The method further includes providing at least one fastener comprising a second polymeric material, and securing the second chair structure with the first chair structure by inserting the at least one fastener into at least one of the obscured apertures of the densely-spaced array of apertures.

These and other features and advantages of the present invention will be further understood and appreciated by those skilled in the art by reference to the following specification, claims, and appended drawings.

DETAILED DESCRIPTION OF THE PREFERRED EMBODIMENTS

Individual and corporate consumers continue to desire products that provide improved environmental indicators. In certain instances, corporate, local, state, or federal environmental policies or regulations may promote or require the selection of products with improved environmental performance or that may be more easily recycled. Upholstered furniture often relies on traditional, metal staples to secure upholstery to a furniture frame. The presence of metal staples, however, may make it more difficult to recycle upholstered furniture. Including an array of apertures configured to receive a staple that is fully or partially comprised of a polymeric material may allow upholstered furniture to be more easily recycled. As a result, arrays of apertures and polymeric staples may be used to improve the environmental performance of chairs and other upholstered furniture.

Figure 1:
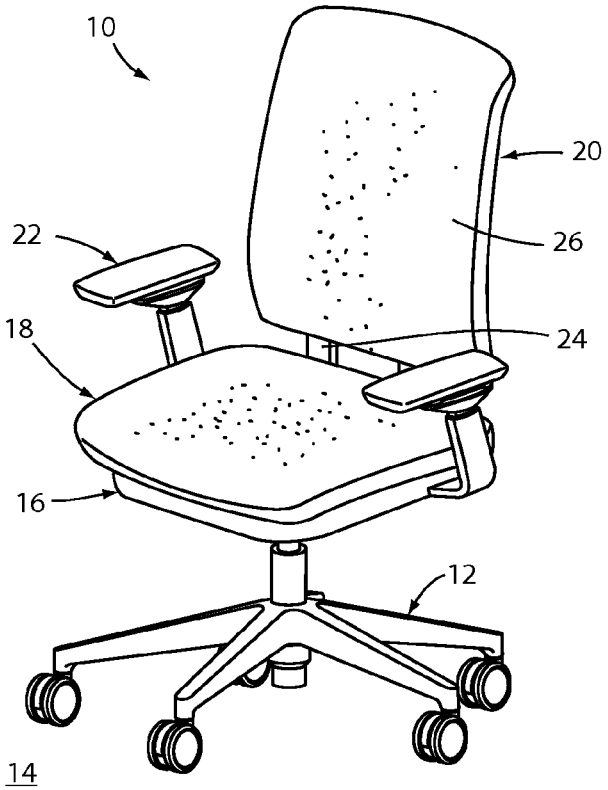
FIG. 1 is a front perspective view of a chair assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. The term "chair" as utilized herein encompasses various seating arrangements, including office chairs, vehicle seating, home seating, stadium seating, theater seating, and the like.

The reference numeral 10 (FIG. 1) generally designates a chair assembly embodying the present invention. In the illustrated example, the assembly 10 includes a castered base assembly 12 abutting a supporting floor surface 14, a control or support assembly 16 supported by the castered base assembly 12, a seat assembly 18 and a back assembly 20 each operably coupled with and supported by the control assembly 16, and a pair of arm assemblies 22.

Figure 2:
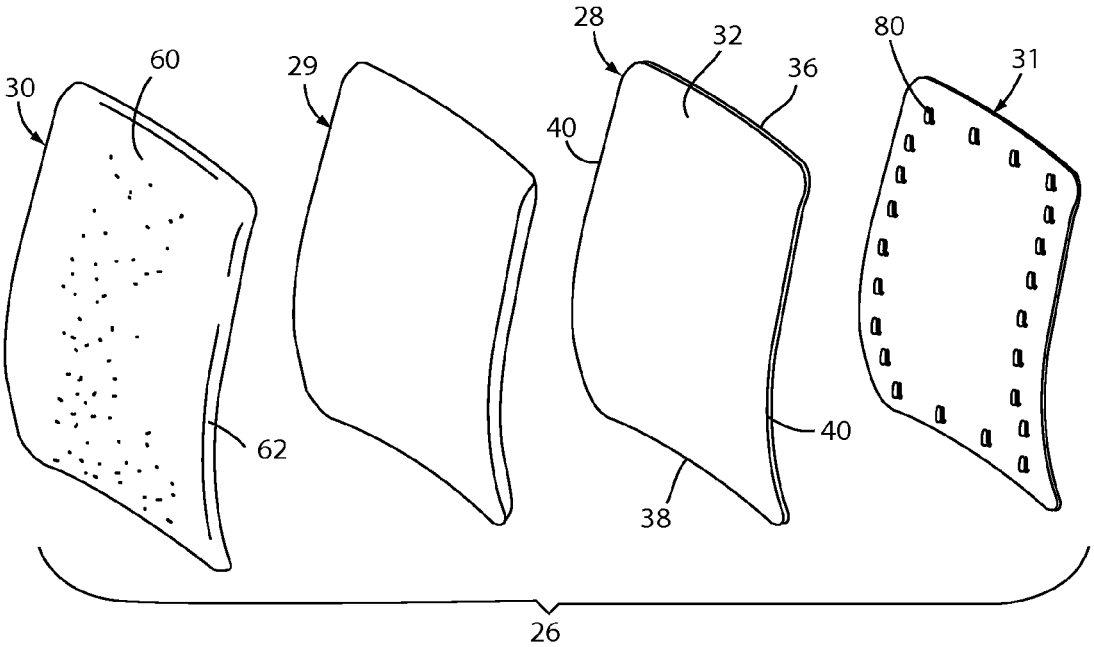
FIG. 2 is an exploded front perspective view of a back assembly of the chair assembly.
Figure 3:
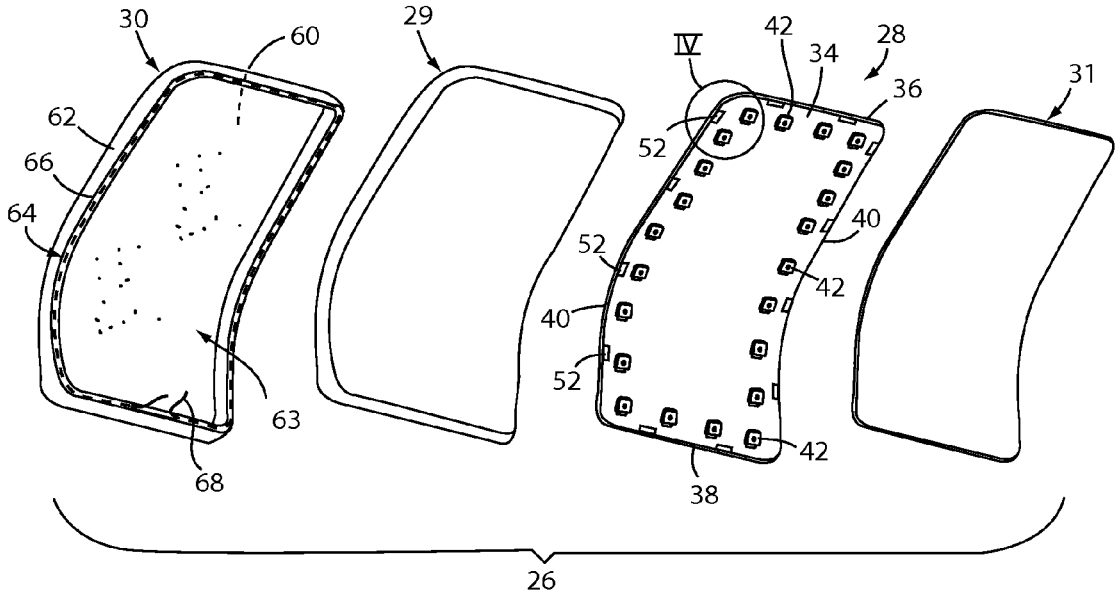
FIG. 3 is an exploded rear perspective view of the back assembly.

The back assembly 20 includes a back frame assembly 24 and a back support assembly 26 supported thereby. The back frame assembly 24 is generally comprised of a substantially rigid material such as metal. The back support assembly 26 (FIGS. 2 and 3) includes a flexibly resilient back shell or inner shell member 28, a foam back cushion 29, a cover assembly 30 covering the back cushion 29 and portions of the back shell 28, and a back housing or outer shell member 31 coupled with the inner shell member 28.

In the illustrated example, the cover assembly 30 comprises an upholstery cover including a front panel 60, a plurality of side panels 62 extending about the periphery of the front panel 60 and that cooperate therewith to form an interior space 63, and a drawstring arrangement 64 extending about the periphery of the side panels 62. The drawstring arrangement 64 includes a drawstring tunnel 66 extending about the periphery of the side panels 62, and a drawstring 68 extending through the drawstring tunnel 66.

The inner shell member 28 includes a forwardly facing surface 32, a rearwardly facing surface 34, a top edge 36, a bottom edge 38, and a pair of side edges 40, extending between the top edge 36 and the bottom edge 38. The inner shell member 28 is preferably comprised of a recyclable material such as a polymeric material, specifically a thermoplastic polymer, and more specifically polypropylene, although other suitable materials may also be utilized, including nylon, ultra-high-molecular-weight polyethylene (UHMW), NORYL™ (available from Sabic, Inc.) and the like.

Figure 4A:
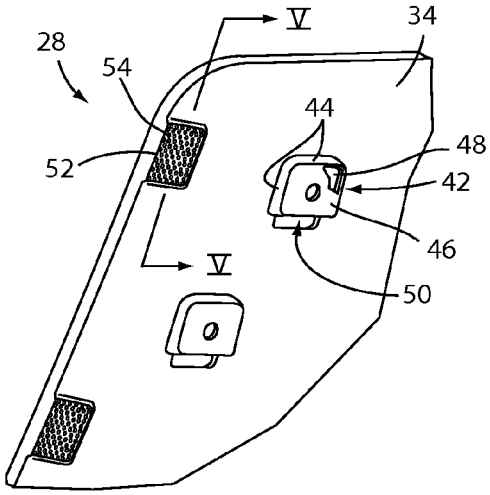
FIG. 4A is an enlarged perspective view of the area IV, FIG. 3.

As best illustrated in FIG. 4A, the inner shell member 28 includes a plurality of box-shaped couplers 42 spaced about a periphery of the upper portion inner shell member 28 and extending rearwardly from the rearwardly facing surface 34. Each box-shaped coupler 42 includes a pair of side walls 44 and a rear wall 46 that cooperate to form an interior space 48 accessible via a downwardly-facing opening 50. The box-shaped couplers 42 allow the back housing 31 to be coupled to the inner shell member 28. In other embodiments, a back housing may be coupled to an inner shell member in a variety of ways.

The inner shell member 28 further includes a plurality of upholstery alignment and connection pads 52 extending rearwardly from the rearwardly facing surface 34 and spaced about the outer periphery of the inner shell member 28. Each pad 52 includes a densely-spaced array of apertures 54 extending between the forwardly facing surface 32 and the rearwardly facing surface 34. Although shown as extending completely through the thickness t of each pad 52, it is noted that the apertures 54 may also extend partially therethrough depending upon the configuration of certain fasteners used therewith, as described below. Pads 52 formed separately and coupled to the inner shell member 28 may be made from the same material as inner shell member 28 or material that is compatible from a recyclability perspective.

Arrays may be located around the perimeter of inner shell member 28. In particular embodiments, the arrays may be located along the perimeter at positions advantageous for securing upholstery to inner shell 28. Advantageous positioning may vary depending on the geometry of the furniture component to be upholstered, the type of material used for upholstery, and other factors, such as the presence of a drawstring or an extrusion. In some embodiments, arrays of apertures may be positioned directly on the edge of an inner shell member as illustrated in FIG. 4A. In other embodiments, arrays may be spaced from the edge of an inner shell member.

Figure 4B:
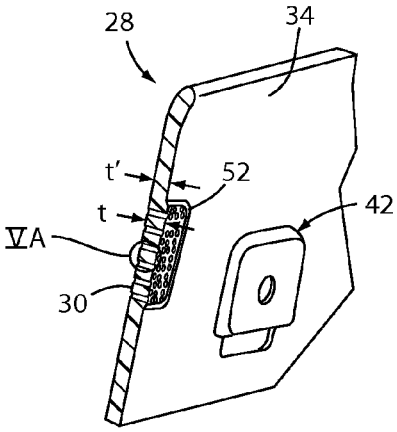
FIG. 4B is a cross-sectional view of a back shell of the back assembly taken along the lines of V-V, FIG. 4.

As best illustrated in FIG. 4B, the thickness t of the inner shell member 28 in the region of the pads 52 is greater than the thickness t' of the inner shell member 28 in other regions of the inner shell member 28. In the illustrated example, the majority of the area of the inner shell member 28 comprises the thickness t'. The pads 52 may function to increase the structural rigidity of the inner shell member 28 in the areas the cover assembly 30 is attached thereto, as well as to provide alignment features for properly aligning the cover assembly 30 with respect to the inner shell member 28 during assembly. Conversely, in some embodiments the thickness t of the inner shell member in the region of the pads 52 may be less than the thickness t' of the inner shell member 28 in other regions of the shell. For example, in certain embodiments, the pads and the other regions of the inner shell member 28 may be flush on the rearwardly facing surface of the inner shell member 28 and the thickness t' of the pad is less on the forwardly facing surface than the thickness t of the other regions of the inner shell member, which results in a space on the forwardly facing surface of the inner shell member suitable to receive the barbs of a variety of fasteners. In particular embodiments, the thicknesses t and t' may be approximately equivalent, which may decrease manufacturing and tooling costs.

Figure 5A:
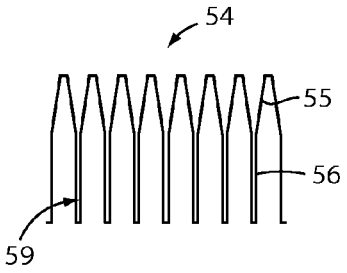
FIG. 5A is an exploded cross-sectional view of an array of apertures of the back shell.
Figure 5B:
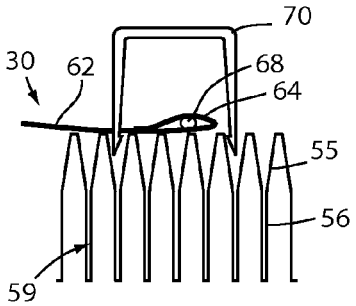
FIG. 5B is an exploded cross-sectional view of a staple being inserted within the apertures to secure a drawstring arrangement.

FIG. 5A illustrates a cross sectional view of the array of apertures 54. Each aperture of the array includes a funnel portion 55 and a hole portion 56. Funnel portions 55 help direct fasteners into hole portions 56. Using a funnel shape also decreases the flat surface area of the pad, which may reduce breakage and improve effectiveness of polymeric fasteners. FIG. 5B illustrates a cross sectional view of a staple 70 piercing the side portion of the cover assembly 30 and coming into contact with the array of apertures 54. As the barbs of the staple 70 come into contact with the array of apertures 54, the funnel portions 55 by virtue of their shape guide the staple 70 into hole portions 56, thereby securing side portion 62 and drawstring arrangement 64 to inner shell member 28. By directing the staple 70 into hole portions 56, funnel portions 55 may improve manufacturing speeds. For example, an upholsterer may forego identifying specific holes within the array and instead may apply the staple 70 to the array of apertures 54, allowing funnel portions 55 to catch and direct the staple 70 into appropriate hole portions 56 to secure the upholstery. The density of the array of apertures as discussed in conjunction with FIG. 4A helps to ensure that the distal end or ends of a fastener come into contact with a funnel portion of an aperture. Other embodiments may include other advantageous aperture shapes. It is further noted the staple 70 may extend completely through the associated apertures 54 such that the barbs of the staple abut a back surface of the article, or may be sized such that the barbs frictionally engage the side walls of the apertures.

Figure 6:
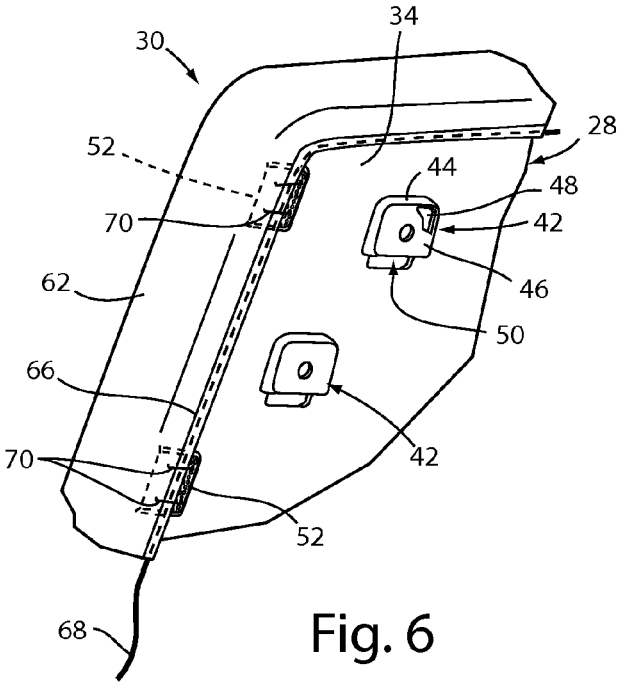
FIG. 6 is an enlarged perspective view of a cover assembly secured to a back shell.

In assembly, the foam layer 29 and the inner shell member 28 (FIG. 6) are positioned within the interior space 63 of the cover assembly 30 as the side panels 62 of the upholstery assembly 30 are wrapped about the top edge 36, the bottom edge 38 and the side edges 40 of the inner shell member 28. The side panels 62 of the cover assembly 30 are wrapped about the inner shell member 28 and the drawstring tunnel 66 is aligned with the connection pads 52 such that the cover assembly 30 covers a portion or subset of the array of apertures 54 of each connection pad 52, thereby properly aligning the cover assembly 30 with the inner shell member 28. The cover assembly 30 is then secured to the inner shell member 28 by a plurality of polymeric staples 70 that pierce the cover assembly 30 and are received into select apertures of the array of apertures 54 as discussed above. The assembled configuration may vary. For example, some cover assemblies 30 may alter or omit a drawstring arrangement 64. In certain embodiments, the cover assembly 30 may fully cover the array of apertures 54 and each staple 70 may pierce the cover assembly multiple times. The positioning of the cover assembly 30 in relation to the array of apertures 54 may depend on the upholsterer, the geometry of the furniture component to be upholstered, the upholstery material, the presence of a drawstring or an extrusion, the size and type of staple, and a variety of other factors.

Figure 7A:
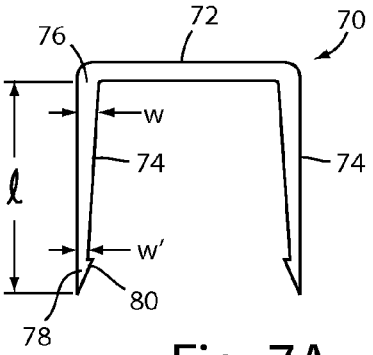
FIG. 7A is a front elevational view of a first embodiment of a staple.
Figure 7B:
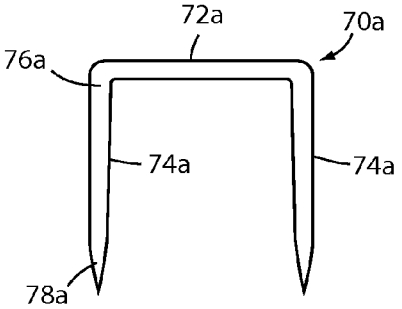
FIG. 7B is a front elevational view of a second embodiment of the staple.
Figure 8:
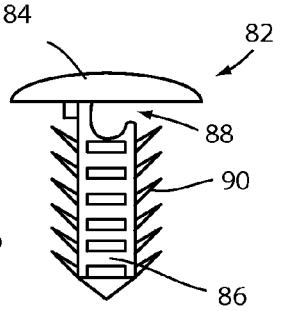
FIG. 8 is a front elevational view of a fastener including a single prong.

As best illustrated in FIG. 7A, each staple 70 includes a cross-portion 72 and a pair of prongs 74 extending from opposite ends of the cross-portion 72. Each prong 74 decreases in width or thickness along the length l thereof, from a width w at a proximal end 76 located near the prong 74, to a width w' at a distal end 78. Each prong 74 includes a flexible resilient barb 80 located at the distal end 78 thereof. Alternatively, the staple 70*a* (FIG. 7B) may be provided without the barbs 80. Other alternatively configured fasteners may also be utilized, such as a "Christmas-tree" type fastener 82 (FIG. 8), wherein the fastener 82 includes a head portion 84, a single prong 86, a relief 88 spaced along the length of the single prong 86 to receive a portion of the cover assembly 30 therein, and a plurality of engagement rings or tabs 90 spaced along the length of the single prong 86. The staples 70, 70*a* and the "Christmas-tree" type fastener 82 are each preferably comprised of a recyclable material such as a polymeric material, specifically a thermoplastic polymer, and more specifically polypropylene, although other suitable materials may also be utilized, including nylon, UHMW, NORYL™, and the like. Preferably, the staples 70, 70*a* and the fastener 82 are comprised of a material that may be recycled with the inner shell member 28 without requiring separation therefrom, and more preferably the staples 70, 70*a* and the fastener 82 are comprised of the same material of which the inner shell member 28 is comprised. Staples 70, 70*a* , and fastener 82 are sufficiently strong to pierce a variety of upholstery materials, including for example, fabrics, leathers, and knits. In certain embodiments, fasteners, including for examples the staples and Christmas tree fastener described herein, may include one or more inert materials, such as chalk. The presence of one or more inert materials may improve the characteristics of the fasteners by strengthening them and/or reducing brittleness without significantly negatively impacting recyclability. Further, in various embodiments, a fastener may be made from more than one material. For example, the prongs 74 may be a more recyclable material such as a polymeric material and the cross-portion 72 may be a less recyclable material such as a metal. In embodiments where a fastener is made from more than one material, the fastener may break more easily at the point where different materials meet. This may allow a less recyclable portion of the fastener to break off when the upholstery is removed and prior to recycling.

As noted above, the staple 70 is received within selective apertures of the array of apertures 54. The densely-packed configuration and arrangement of the array of apertures 54 allows the fastener to engage one of the closest apertures to the point of attachment without requiring visual alignment of the same. Specifically, and as noted above, the side panels 62 may obscure all or a portion of the array of apertures 54 of each pad 52 when aligned with the pad 52. In assembly, an operator utilizes a staple gun or other suitable device to attach the cover assembly 30 to the inner shell member 28 by piercing the cover assembly 30 with at least one of the prongs 74 and forcing each prong 74 into one of the apertures of the array of apertures 54. In the illustrated example, each staple 70 bridges the drawstring 68 and/or drawstring tunnel 66 with the cross-portion 72 thereof, such that one of the prongs 74 pierces the upholstery of the side panel 62 and each prong 74 is inserted into an associated aperture of the array of apertures 54. In various embodiments, staples 70 may alternatively or additionally bridge an extrusion and may pierce the upholstery with one or both prongs. In certain circumstances, staples 70 may secure upholstery without the aid of a drawstring, extrusion, or other attachment device and may do so by piercing the upholstery with one or both prongs. Staples 70 may also pierce the upholstery with both prongs in certain locations about an inner shell member or other structural component, while piercing the upholstery with one prong at other positions.

Figure 9:
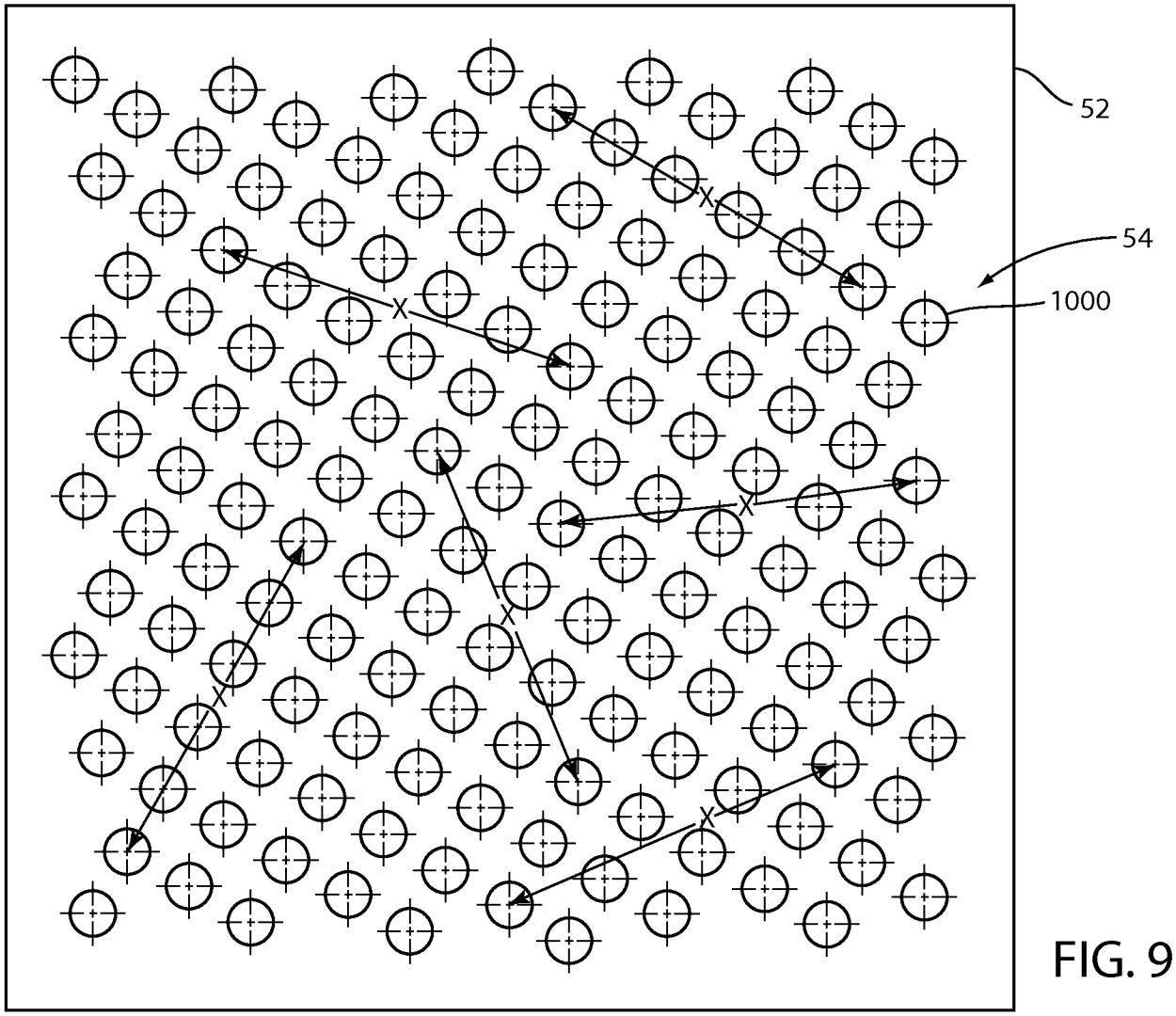
FIG. 9 is an elevational view of a first embodiment of an array of apertures including distances between various apertures.
Figure 9A:
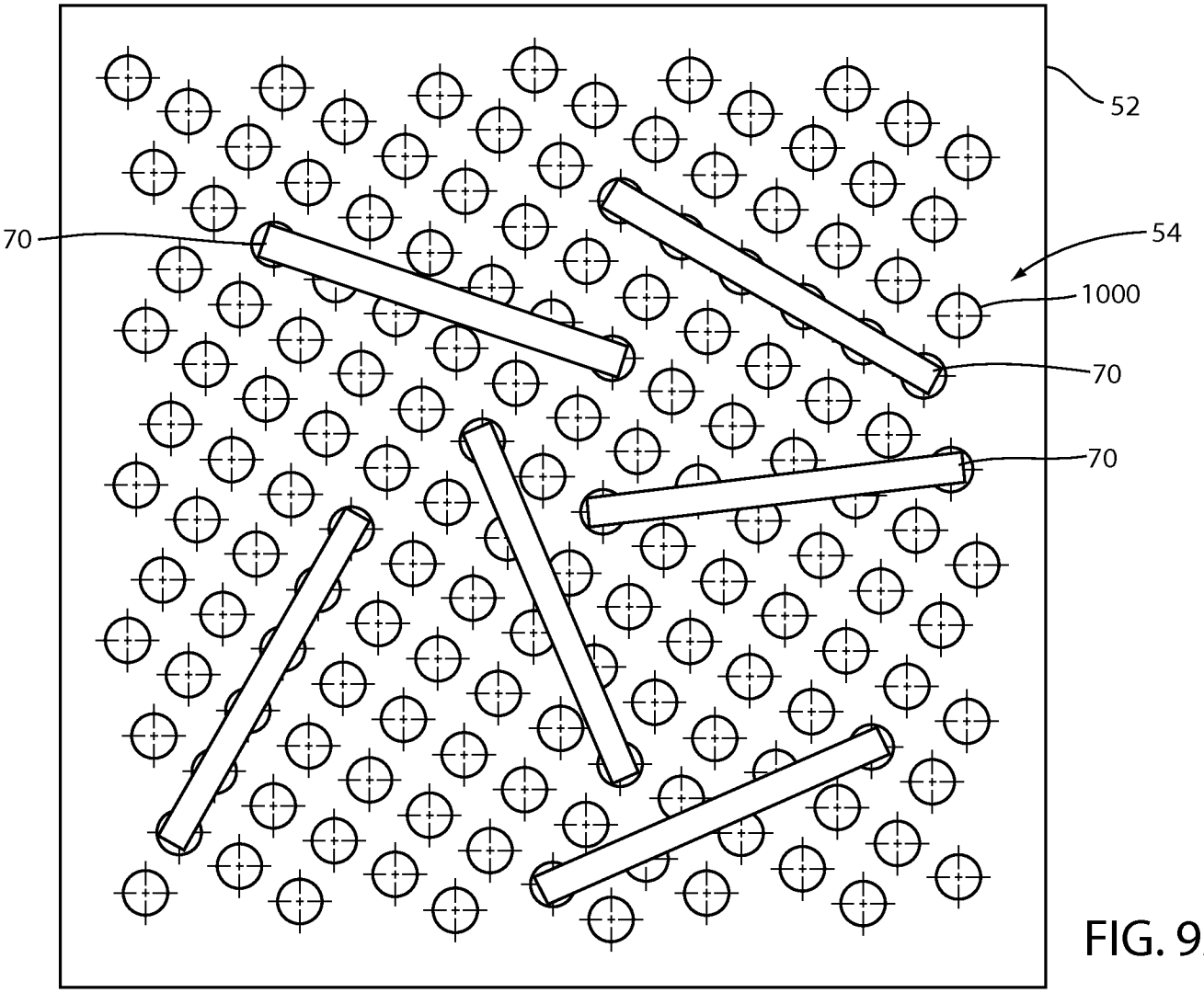
FIG. 9A is an elevational view of the first embodiment of the array of apertures including a plurality of staples secured thereto.
Figure 10:
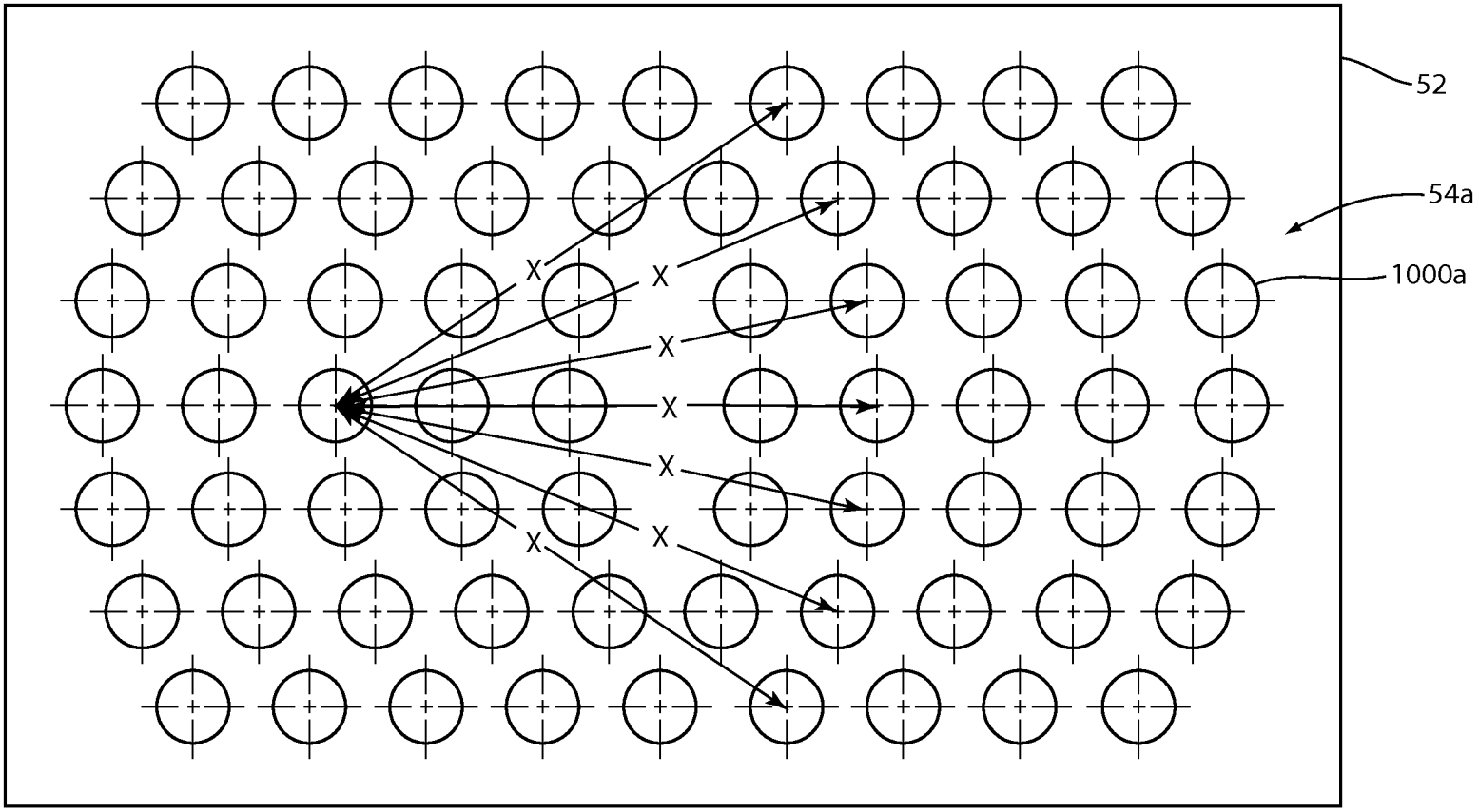
FIG. 10 is an elevational view of a second embodiment of an array of apertures including distances between various apertures.
Figure 10A:
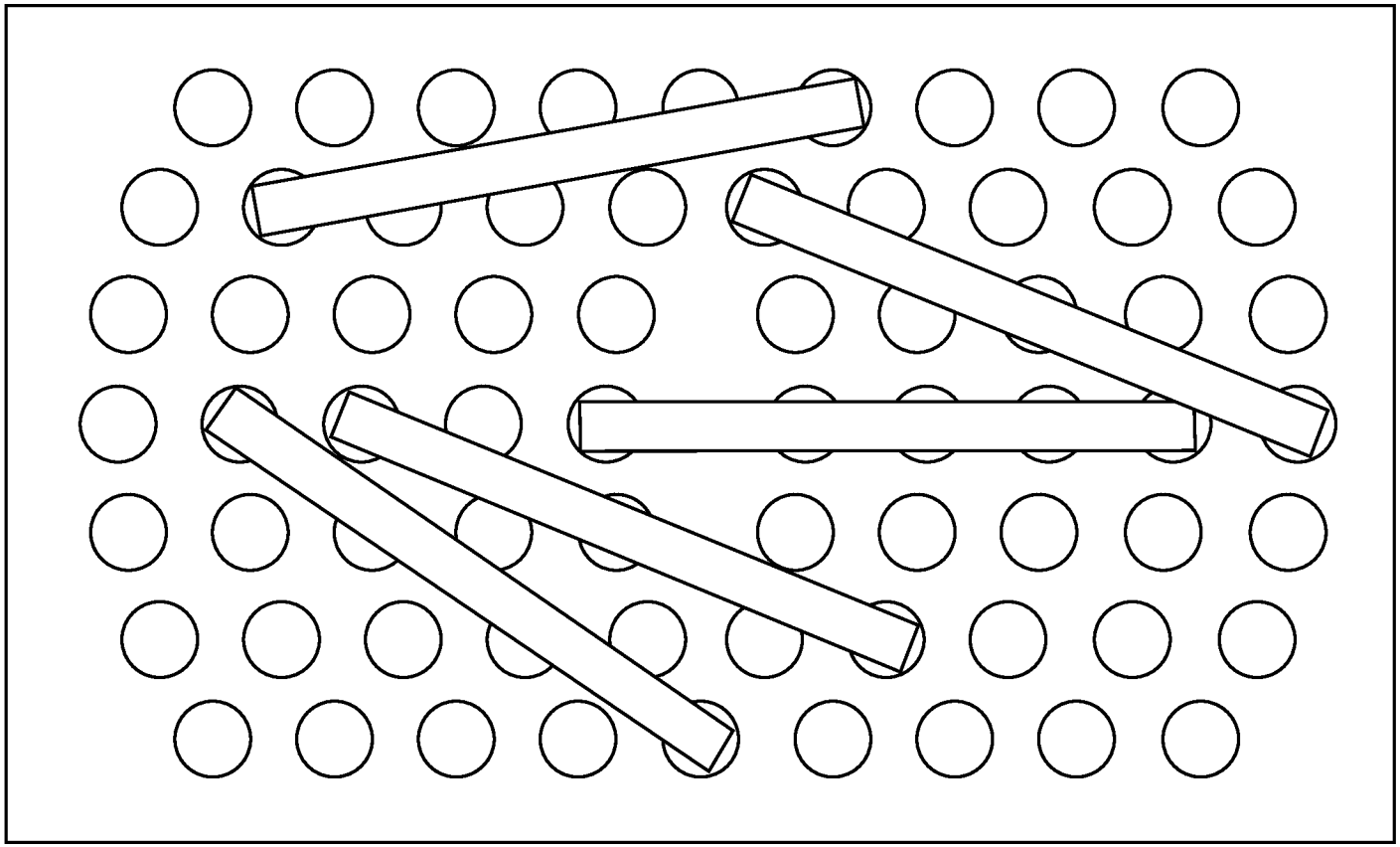
FIG. 10A is an elevational view of the second embodiment of the array of apertures including a plurality of staples secured thereto.

The array of apertures 54 are preferably provided in a pattern to prescribe or require a particular preselected orientation of fasteners used therewith, and particularly the staples 70. The apertures may be arranged within the array according to a regularly spaced pattern or may be arranged irregularly. As best illustrated in FIGS. 9 and 9A, the array of apertures 54 includes a plurality of apertures 1000 that may be regularly and equally spaced from one another such that a distance X is defined between various apertures 1000, which is substantially similar to the distance Y (FIG. 7A) defined between the prongs 74 of the staple 70. This spacing arrangement allows the staples 70 to be located in a plurality of positions within the array 54, as illustrated in FIG. 9A. Other constantly repeatable spacing and positioning of the apertures 1000 may also be employed. Alternatively, the apertures 1000*a* (FIG. 10) of the array of apertures 54*a* may be spaced and aligned with one another in a pattern such that the staples 70 (FIG. 10A) may be placed in a variety of positions within the array, but also such that at least some of the apertures 1000*a* are spaced the distance X from multiple other apertures 1000*a*. As shown in FIG. 10, the apertures 1000*a* are placed in a repeating arcuate pattern such that at least some apertures 1000*a* are equally spaced the distance X from multiple other apertures, thereby easing assembly by allowing the staple 70 to be secured in a plurality of orientations with respect to the overall array of apertures 54*a*. The array of apertures 54*a* is patterned such that at least some of the apertures 1000*a* are spaced the distance X preferably from at least two other apertures 1000*a*, more preferably from at least three other apertures 1000*a*, and most preferably from at least six other apertures 1000*a*. Although an arcuate pattern is illustrated in FIGS. 10 and 10A, other patterns providing the alignment as discussed herein may also be utilized.

The assembly of the inner shell member 28, the foam cushion 29 and the cover assembly 30 is then assembled with the outer shell member 31 by aligning and inserting a plurality of forwardly and upwardly extending hooks 80 into the corresponding couplers 42 via the openings 50 thereof. While a specific connection arrangement between the outer shell member 31 and remaining components is illustrated, other suitable connection arrangements may be utilized.

Figure 11:
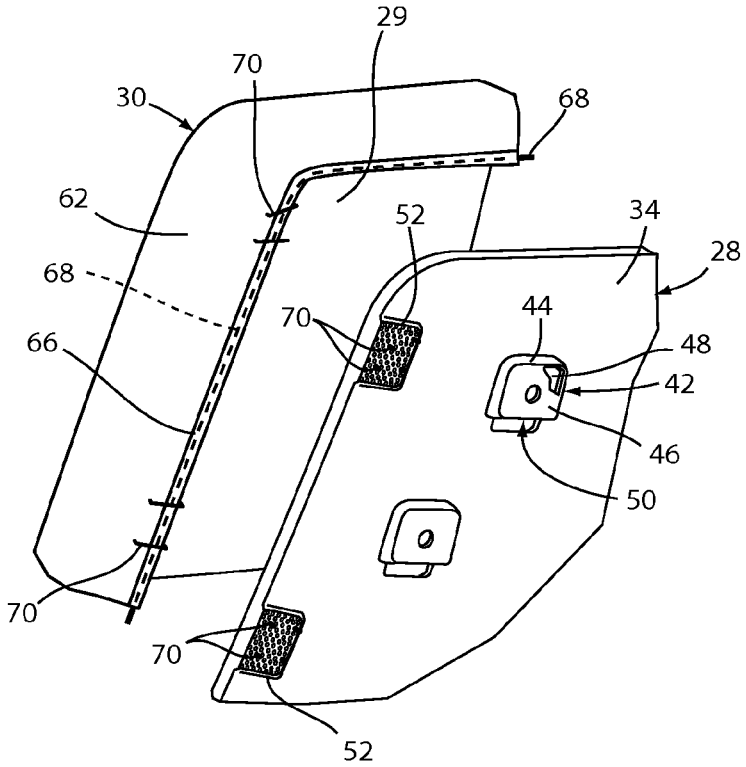
FIG. 11 is an exploded perspective view of the cover assembly disassembled from the back shell, wherein portions of broken staples remained engaged with the back shell.

At the end of its useful life, the chair 10 may be disassembled to allow for the recycling of its parts. Recycling often requires that like materials are sorted together. For example, metals are sorted with other metals, plastics are sorted with other plastics, etc. Therefore, to facilitate recycling cover assembly 30 and cushion 29 are removed from inner shell member 28. As cover assembly 30 is removed, staples 70 may be dislodged from their apertures. Often in disassembly, one or more staples 70 or portions of broken staples 70 may remain coupled to the inner shell member 28 and may be recycled without being removed from the inner shell member. Specifically, as best illustrated in FIG. 11, the staple 70 or portion of the staple 70 may remain engaged within one of the apertures of the array of apertures 54. Indeed, in certain embodiments, staples 70 may be designed to allow cross-portion 72 to break away during the removal of cover assembly 30. Providing staples 70 that may be recycled with inner shell member 28 instead of requiring removal may reduce the time and costs associated with recycling. Including an array of apertures configured to receive a staple that is fully or partially comprised of a polymeric material may improve the environmental indicators of chair 10. In various embodiments, similar arrays of apertures and polymeric staples may be used with a variety of upholstered furniture components to improve the recyclability of the components.

Figure 12:
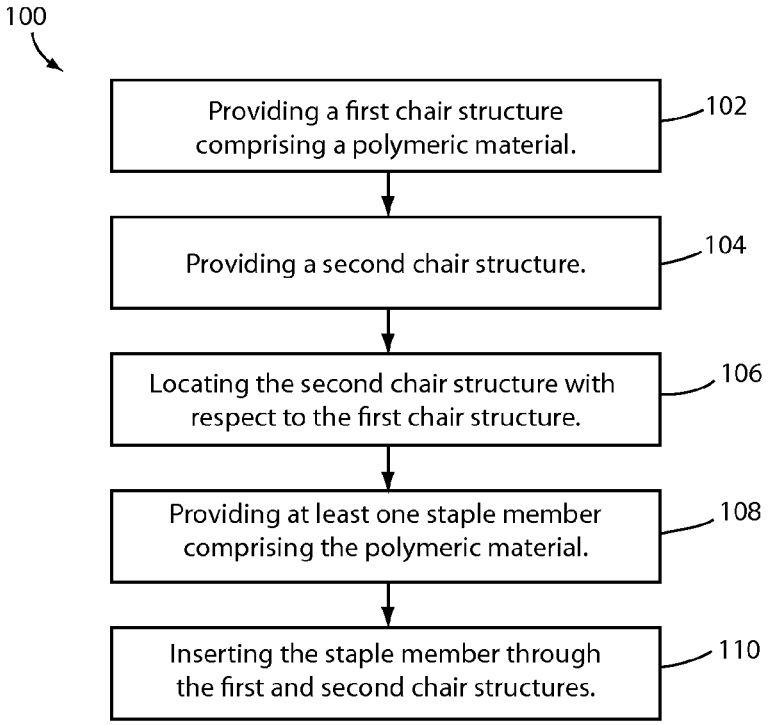
FIG. 12 illustrates an exemplary method of constructing a chair.

FIG. 12 illustrates a method 100 of constructing a chair in accordance with various embodiments. Method 100 begins at step 102 by providing a first chair structure comprising a first polymeric material and having a first surface and a second surface opposite the first surface, the first surface and the second surface cooperating to define a first thickness therebetween, the first chair structure including at least one attachment area. In some embodiments, the first chair structure may include a plurality of apertures. In addition, the first polymeric material may be a recyclable polymer in various embodiments.

Method 100 continues by providing a second chair structure at step 104 and by locating the second chair structure proximate the first chair structure such that at least a portion of the second chair structure covers the first chair structure at step 106. The second chair structure may comprise a cover in various embodiments.

Step 108 illustrates providing at least one staple member comprising the polymeric material. In certain embodiments, the at least one staple member may be recycled with the first chair structure because both comprise the same polymeric material.

In one embodiment, method 100 concludes at step 110 by inserting the at least one staple member through the first chair structure and the second chair structure with a staple gun, thereby securing the first chair structure to the second chair structure. In some embodiments, the step of inserting the at least one staple through the first chair structure includes inserting the at least one staple into one or more of the plurality of apertures.

Depending on the embodiment, method 100 may include alternate or additional steps. For example, the second chair structure may include a drawstring and the step of inserting the at least one staple member through the second chair structure may include securing the drawstring to the first chair member by the at least one staple member. Further this or a similar method may be applied to a variety of upholstered furniture components or articles.

Figure 13:
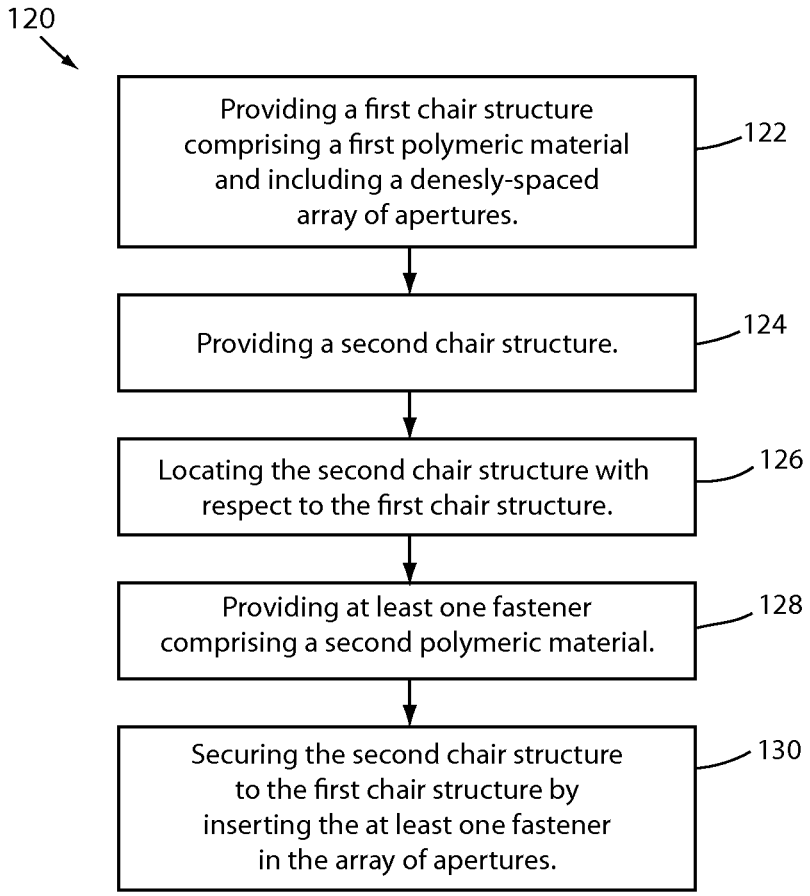
FIG. 13 illustrates another exemplary method of constructing a chair.

FIG. 13 illustrates a method 120 in accordance with various embodiments. Method 120 begins at step 122 by providing a first chair structure comprising a first polymeric material and having a first surface and a second surface opposite the first surface, wherein the first chair structure may include a densely-spaced array of apertures extending between the first and second surfaces. In addition, the first polymeric material may be a recyclable polymer in various embodiments.

Method 120 continues by providing a second chair structure at step 124 and by locating the second chair structure proximate the first chair structure such that at least a portion of the second chair structure obscures at least a portion of the densely-spaced array of apertures at step 126. The second chair structure may comprise a cover in various embodiments.

Step 128 illustrates providing at least one fastener member comprising a second polymeric material. In certain embodiments, the at least one fastener may be recycled with the first chair structure because both comprise a polymeric material.

In one embodiment, method 120 concludes at step 130 by securing the second chair structure to the first chair structure by inserting the at least one fastener into the obscured apertures of the densely-spaced array of apertures.

Depending on the embodiment, method 120 may include alternate or additional steps. For example, the second chair structure may include a drawstring and the step of inserting the at least one fastener through the second chair structure which may include an upholstery arrangement, and that may include securing the drawstring to the first chair member by the at least one fastener. Further this or similar method may be applied to a variety of upholstered furniture components or articles.

The present inventive chair upholstery attachment arrangement, including the provides assembly personnel a simplified means of aligning cover assembly 30 with an inner shell member 28, while simultaneously reducing the complexity, time and cost associated with recycling the chair components after the useful life of the chair. The attachment arrangement reduces assembly and recycling costs, includes an uncomplicated design, may be easily and quickly assembled and disassembled by personnel without requiring training, and is particularly well adapted for the proposed use.

In the foregoing description, it will be readily appreciated by those skilled in the art that alternative combinations of the various components and elements of the invention and modifications to the invention may be made without departing from the concepts of the original invention when the concept is disclosed, such as applying the inventive concepts as disclosed herein to vehicle seating, stadium seating, home seating, theater seating and the like. Such modifications are to be considered as included in the following claims, unless these claims by their language expressly state otherwise.

The invention claimed is:

1. A chair, comprising:

a chair component comprising a first polymeric material and adapted to at least partially support a seated user, the chair component including a first surface and a second surface opposite the first surface, the chair component further including a plurality of apertures capable of being accessed from at least the second surface of the chair component;

a cover that extends over at least a portion of the first surface and a portion of the second surface which includes the plurality of apertures; and at least one or more staples comprising a second polymeric material, each staple of the at least one or more staples including a pair of prongs, wherein at least one of the prongs extends through the cover extending over the portion of the second surface and is received and retained within one of the plurality of apertures, thereby securing the cover to the chair component, and wherein the second polymeric material of the at least one of more staples may be recycled with the first polymeric material of the chair component without requiring separation of the at least one or more staples from the chair component.

2. The chair of claim 1, wherein the at least one or more staples comprises a thermoplastic polymer.

3. The chair of claim 2, wherein the at least one or more staples comprises polypropylene.

4. The chair of claim 1, wherein each of the prongs are tapered along a length thereof.

5. The chair of claim 4, wherein each of prongs are tapered along a majority of a total length of each of the prongs.

6. The chair of claim 1, wherein the at least one of the prongs includes a barb located at an end thereof.

7. The chair of claim 6, wherein the barb is elastically deformable.

8. The chair of claim 1, wherein the chair component and the at least one staple member are comprised of the same material.

9. The chair of claim 1, wherein the chair component includes a back shell.

10. The chair of claim 1, wherein the cover comprises an upholstery arrangement.

11. The chair of claim 10, wherein the upholstery arrangement includes a fabric.

12. The chair of claim 1, wherein the cover comprises a drawstring operably coupled with a cover member to draw the cover member over the at least portion of the first surface, and wherein the drawstring is secured to the chair component by the at least one or more staple member.

13. A chair, comprising:

a chair component comprising a polymeric material and adapted to at least partially support a seated user, the chair component including a first surface and a second surface opposite the first surface, the chair component further including a plurality of apertures arranged in at least one array and capable of being accessed from at least the second surface of the chair component;

an upholstery element that extends over at least a portion of the first surface and a portion of the second surface which includes the plurality of apertures so as to at least partially cover a portion of the plurality of apertures; and at least one fastener comprising a polymeric material, the at least one fastener engaging the upholstery element that extends over the portion of the second surface and is received and retained within at least one aperture of the plurality of apertures, thereby securing the upholstery element to the chair component; and wherein the total number of apertures of the plurality of apertures is greater than the total number of the at least one fastener.

14. The chair of claim 13, wherein the at least one fastener comprises at least one prong.

15. The chair of claim 14, wherein a total number of the apertures of the plurality of apertures is greater than a total number of the at least one prong.

16. The chair of claim 13, wherein the at least one array of the plurality of apertures includes at least one aperture that is equally spaced from at least two other apertures of the at least one array of the plurality of apertures.

17. The chair of claim 13, wherein the at least one array of the plurality of apertures includes at least one aperture that is equally spaced from at least six other apertures of the at least one array of the plurality of apertures.

18. The chair of claim 13, wherein the plurality of apertures are densely-spaced within the at least one array, and wherein the at least one fastener randomly engages the at least one of the apertures of the plurality of apertures.

19. The chair of claim 13, wherein the at least one plurality of the plurality of apertures extend completely between the first surface and the second surface.

20. The chair of claim 13, wherein the first surface and the second surface cooperate to define a first thickness therebetween, the chair component further includes at least one raised portion extending from the second surface, the first surface and the at least one raised portion define a second thickness therebetween that is greater than the first thickness, a majority of the chair component comprises the first thickness, and wherein the at least one array of the plurality of apertures is located within the at least one raised portion.

21. An article of furniture, comprising:

a furniture component comprising a first polymeric material, the furniture component including a first surface and a second surface opposite the first surface;

a compliant material that wraps about at least a portion of the furniture component and covers at least a portion of the first surface and a portion of the second surface; and at least one or more staples comprising a second polymeric material that couples the compliant material to the furniture component, each staple of the at least one or more staples comprising two prongs, each prong extending through the compliant material and into the furniture component through the second surface, and wherein the second polymeric material of the at least one or more staples may be recycled with the first polymeric material of the furniture component without requiring separation of the at least one or more staples from the furniture component.

22. The article of furniture of claim 21, wherein the at least one or more staples comprises a thermoplastic polymer.

23. The article of furniture of claim 22, wherein the at least one or more staples comprises polypropylene.

24. The article of furniture of claim 21, wherein each prong includes a barb located at a distal end thereof.

25. The article of furniture of claim 21, wherein the furniture component further includes a plurality of apertures capable of being accessed from at least the second surface, and wherein the at least one or more staples is received within at least one aperture of the plurality of apertures.

26. The article of furniture of claim 25, wherein the plurality of apertures includes at least one array of apertures.

27. The article of furniture of claim 26, wherein the at least one array of apertures comprises a densely-spaced array of apertures.

28. The article of furniture of claim 27, wherein a total number of the apertures of the plurality of apertures is greater than a total number of the prongs of the at least one or more staples.

29. The article of furniture of claim 28, wherein the plurality of apertures are densely-spaced within the at least one array and wherein the prongs of the at least one staple randomly engage apertures of the at least one array.

30. The article of furniture of claim 21, wherein the article of furniture comprises a chair.

* * * * *